US009205547B2

(12) United States Patent
Hirabayashi et al.

(10) Patent No.: US 9,205,547 B2
(45) Date of Patent: Dec. 8, 2015

(54) ELECTRIC POWER TOOL WITH VIBRATION MECHANISM

(75) Inventors: Tokuo Hirabayashi, Anjo (JP); Tomoyuki Kondo, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 659 days.

(21) Appl. No.: 13/566,512

(22) Filed: Aug. 3, 2012

(65) Prior Publication Data

US 2013/0032370 A1 Feb. 7, 2013

(30) Foreign Application Priority Data

Aug. 5, 2011 (JP) ..... 2011-171899

(51) Int. Cl.
*B25D 16/00* (2006.01)
*B25D 11/10* (2006.01)
*B25B 21/02* (2006.01)

(52) U.S. Cl.
CPC ..... *B25D 16/006* (2013.01); *B25B 21/02* (2013.01); *B25D 11/106* (2013.01); *B25D 2216/0023* (2013.01); *B25D 2216/0038* (2013.01); *B25D 2216/0084* (2013.01)

(58) Field of Classification Search
CPC ..... B23D 45/16; B23Q 5/00; B25B 21/02; B25D 16/00
USPC ..... 173/47, 48, 178, 216, 104, 109, 176
See application file for complete search history.

(56) References Cited

U.S. PATENT DOCUMENTS

| | | | | |
|---|---|---|---|---|
| 5,505,271 | A * | 4/1996 | Bourner | 173/48 |
| 7,127,839 | B2 * | 10/2006 | Pessayre et al. | 38/77.1 |
| 7,308,948 | B2 * | 12/2007 | Furuta | 173/48 |
| 2010/0193206 | A1 * | 8/2010 | Teng | 173/48 |

FOREIGN PATENT DOCUMENTS

| | | |
|---|---|---|
| JP | A-2006-123080 | 5/2006 |
| JP | B2-4468786 | 5/2010 |

* cited by examiner

*Primary Examiner* — Nathaniel Chukwurah
(74) *Attorney, Agent, or Firm* — Oliff PLC

(57) ABSTRACT

An impact driver with a vibration mechanism includes a vibration switching ring externally fitted to a second cam in the forward position in such a manner that an inner protrusion on the inner circumference is latched a protrusion on the outer circumference of the second cam so that the rotation of the second cam is restricted. Further, a coil spring is provided for biasing the vibration switching ring to the forward position. A link plate provided between the mode switching ring and the vibration switching ring latches onto the front surface of the vibration switching ring and engages an engaging protrusion at the rear end with a mode switching ring. The link plate moves forward or backward to a first position where the vibration switching ring moves to the forward position or a second position where the vibration switching ring moves to the backward position.

15 Claims, 14 Drawing Sheets

ELECTRIC POWER TOOL WITH VIBRATION MECHANISM

This application claims the benefit of Japanese Patent Application Number 2011-171899 filed on Aug. 5, 2011, the entirety of which is incorporated by reference.

BACKGROUND OF INVENTION

1. Technical Field

The present invention relates to an electric power tool such as an impact driver including a vibration mechanism that provides vibration in an axial direction to a final output shaft protruded forward from a housing.

2. Description of the Related Art

An electric power tool with a vibration mechanism includes a final output shaft, such as a spindle or an anvil, that protrudes forward of a housing accommodating a motor and such that rotation is transmitted from the motor, the housing including a vibration mechanism that provides vibration in the axial direction to the final output shaft. For example, Japanese Patent No. 4468786 discloses, as the electric power tool with a vibration mechanism, an impact driver that includes a vibration mechanism including a first cam secured integrally to an anvil as a final output shaft, a second cam that interlocks with the rear of the first cam and is fitted to the exterior of the anvil to be rotatable, and a vibration switching lever (vibration switching member) having, at the front end, a locking tooth capable of meshing with a locking tooth formed on the outer circumference of the second cam. In the impact driver, a connecting protrusion provided to the vibration switching lever is loosely inserted in a vibration switching groove provided to a switch case. By rotating the switch case using a switch button, the vibration switching lever is moved forward or backward to the forward position in which the vibration switching lever meshes with the second cam or the backward position in which the vibration switching lever is apart from the second cam. This enables switching of the vibration on and off.

However, in the conventional electric power tool with a vibration mechanism, the second cam and the vibration switching member are arranged in series in the axial direction, and the locking tooth provided to the front end of the vibration switching member is meshed with the locking tooth on the outer circumference of the second cam. Accordingly, the dimension of the vibration switching member in the axial direction is long and the space occupied by the entire vibration mechanism is large. As a result, it prevents downsizing of the entire tool.

SUMMARY OF THE INVENTION

Thus, it is an object of the present invention to provide an electric power tool with a vibration mechanism that enables a space-saving configuration of an entire vibration mechanism including a vibration switching member so that downsizing of the entire tool is possible.

In order to achieve the object described above, a first aspect of the present invention provides an electric power tool with a vibration mechanism including a final output shaft that protrudes forward of a housing accommodating a motor and to which rotation is transmitted from the motor, a vibration mechanism including a first cam secured integrally to the final output shaft, a second cam that interlocks with a rear of the first cam and is fitted to an exterior of the final output shaft to be rotatable, and a vibration switching member provided in a rear of the second cam to be movable forward or backward between a forward position and a backward position. In the forward position, the vibration switching member is latched the second cam so as to restrict rotation. In the backward position, the vibration switching member is apart from the second cam. The vibration mechanism is configured to provide vibration in an axial direction to the final output shaft. The electric power tool also includes a switching operation member that is provided to the housing and causes the vibration switching member to move forward or backward. The vibration switching member is a ring body that, in the forward position, is fitted to an exterior of the second cam to cause a latching portion provided in an inner circumference to latch onto a latched portion provided in an outer circumference of the second cam so that rotation of the second cam is restricted, while a biasing unit for biasing the vibration switching member to the forward position is provided. Further, a link plate provided between the switching operation member and the vibration switching member latches onto a front surface of the vibration switching member from an outer circumference side to engage a rear end with the switching operation member. Through manipulation of the switching operation member, the link plate moves forward or backward to a first position in which the vibration switching member is allowed to move to the forward position or a second position in which the vibration switching member moves to the backward position A second aspect of the present invention provides a configuration according to the first aspect, in which an inner housing that rotatably supports the final output shaft and holds the vibration mechanism is provided in the housing, and the link, plate is held to be movable forward or backward in an outer groove provided on an outer circumference of the inner housing.

The first aspect of the present invention enables a space-saving configuration of the entire vibration mechanism including the vibration switching member so that downsizing of the entire tool can be achieved.

With the second aspect of the present invention, the link plate can be arranged without being protruded from the outer circumference of the inner housing so that downsizing in the radial direction can be also achieved, in addition to the effect of the first aspect.

DETAILED DESCRIPTION OF THE EMBODIMENTS

An embodiment of the present invention will be described below based on the drawings.

Figure 1:
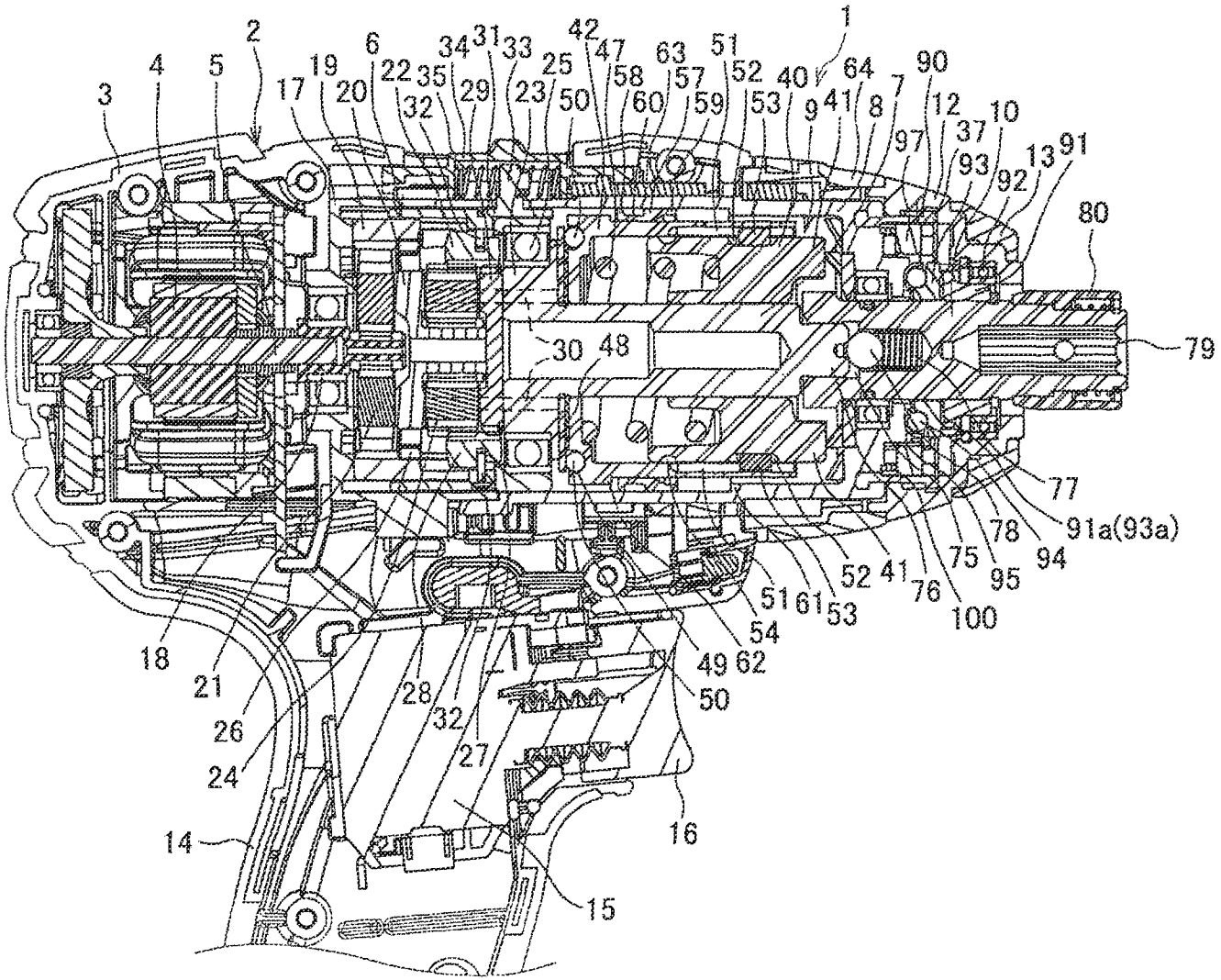
FIG. 1 is a partial vertical-sectional view of an impact driver.
Figure 2:
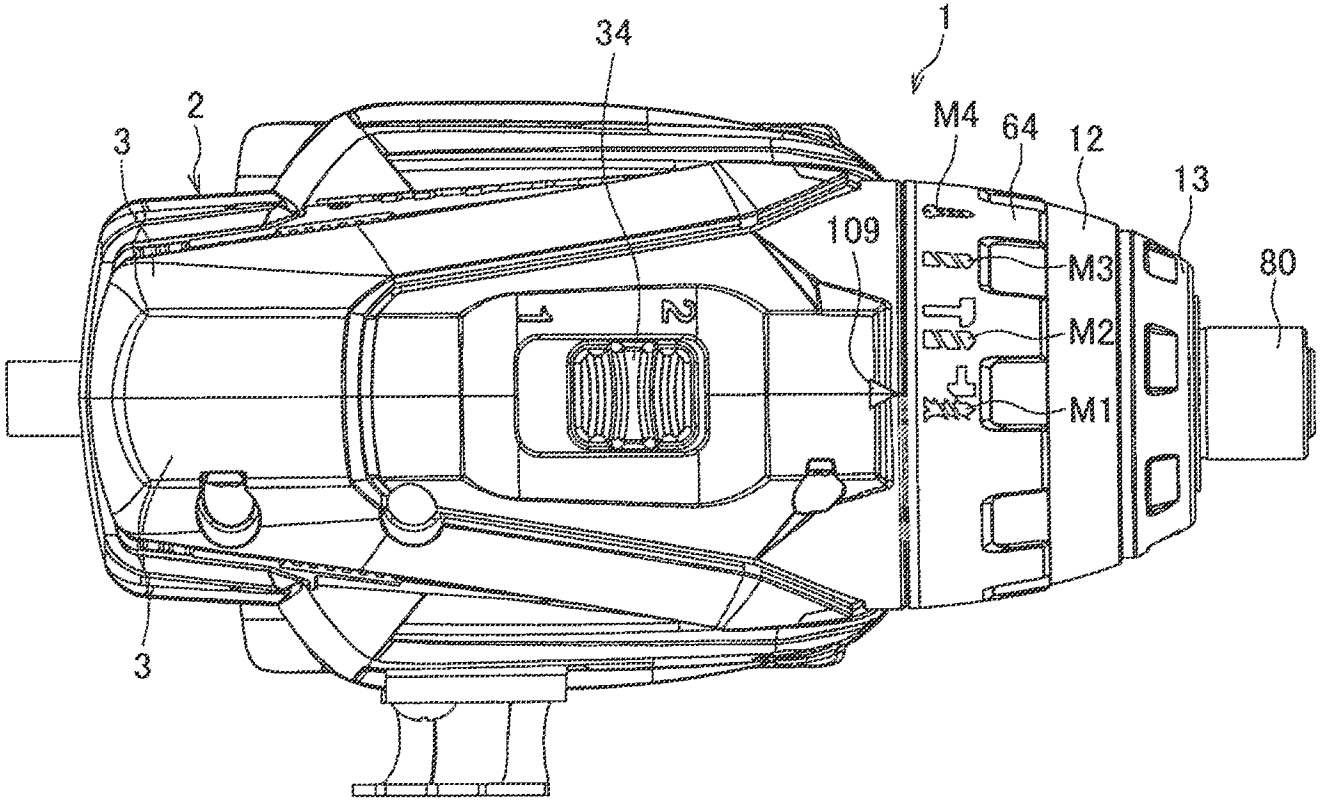
FIG. 2 is a plan view of the impact driver.
Figure 3:
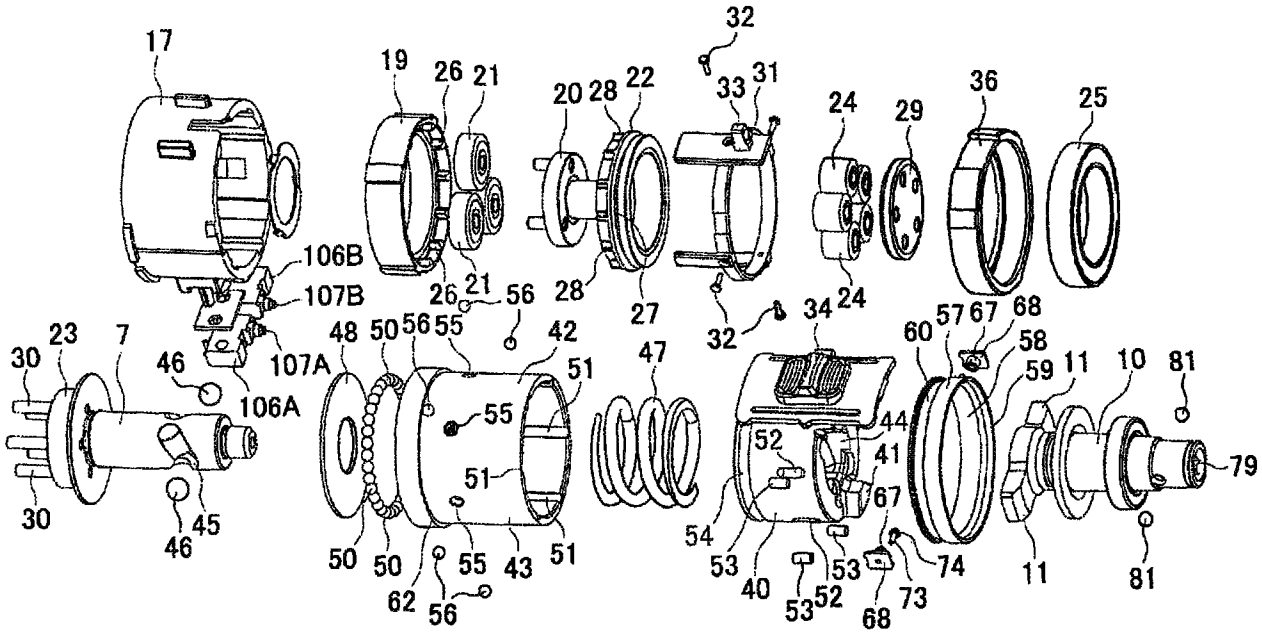
FIG. 3 is an exploded perspective view of an internal mechanism.
Figure 4:
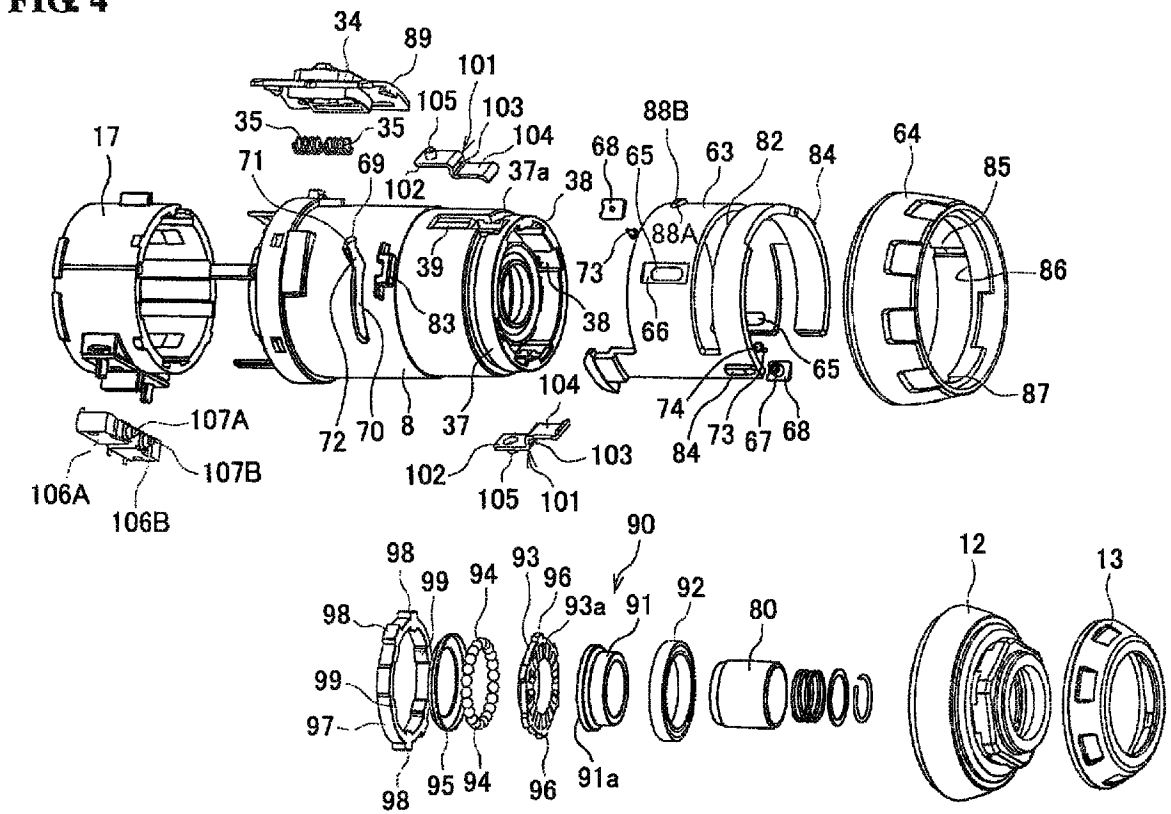
FIG. 4 is an exploded perspective view of a housing and a vibration mechanism other than a body housing.

FIGS. 1 and 2 show an impact driver 1 as one example of an electric power tool, and FIGS. 3 and 4 show a part of an internal mechanism thereof. The impact driver 1 has a body housing 2 formed by assembling left and right half housings 3. In the body housing 2, a motor 4, a planetary gear reduction mechanism 6, and a spindle 7 are accommodated in this order from the rear (with the right side in FIG. 1 being the front). In the front portion of the body housing 2, a cylinder-shaped inner housing 8 accommodating a striking mechanism 9 together with the spindle 7 is assembled. An anvil 10 serving as a final output shaft, which is arranged coaxially with and in front of the spindle 7, is rotatably supported by the inner housing 8 and a front housing 12 fixed at the front end thereof so as to protrude forward. In the front housing 12, a vibration mechanism 90 is accommodated. The planetary gear reduction mechanism 6 and the mechanisms on the front side excluding the body housing 2 form a unit. Reference numeral 13 denotes a ring-shaped bumper made of rubber that is fitted at the front end of the front housing 12. Below the body housing 2, a handle 14 is provided to extend downward. In the handle 14, a switch 15 including a trigger 16 is accommodated.

<Planetary Gear Reduction Mechanism and Transmission Mechanism>

The planetary gear reduction mechanism 6 is accommodated in a cylinder-shaped gear housing 17 assembled in the body housing 2. In the rear portion of the gear housing 17, a pinion 18 fitted to an output shaft 5 of the motor 4 is rotatably supported and protrudes in the gear housing 17. The planetary gear reduction mechanism 6 includes a first carrier 20 holding first-stage planet gears 21 that make planetary motion in a first internal gear 19 and a second carrier 23 holding second-stage planet gears 24 that make planetary motion in a second internal gear 22, such that the first-stage planet gears 21 mesh with the pinion 18. The second carrier 23 is formed integrally with the rear end of the spindle 7 and rotatably supported by a ball bearing 25 in the inner housing 8.

Herein, the first internal gear 19 includes a plurality of internal teeth 26 at predetermined intervals in the circumferential direction on the front inner circumference side. The second internal gear 22 includes a ring-shaped engaging groove 27 on the front outer circumference side and a plurality of outer teeth 28 provided to protrude at predetermined intervals in the circumferential direction on the rear outer circumference side. The second internal gear 22 is provided to be slidable between the forward position and the backward position. In the forward position, the second internal gear 22 meshes with both a spur gear 29 connected integrally with the rear of the second carrier 23 and the second-stage planet gear 24. In the backward position, the outer tooth 28 engages with the internal tooth 26 of the first internal gear 19 so that the second internal gear 22 meshes only with the second-stage planet gear 24.

The spur gear 29 is a separate gear located between the second carrier 23 and the planet gear 24 and penetrated by a support pin 30 that supports the planet gear 24. The outer diameter of the second carrier 23 is smaller than the outer diameter of the spur gear 29 including the tooth tip. Reference numeral 36 denotes a holding ring that holds the ball bearing 25 in the gear housing 17.

Figure 5:
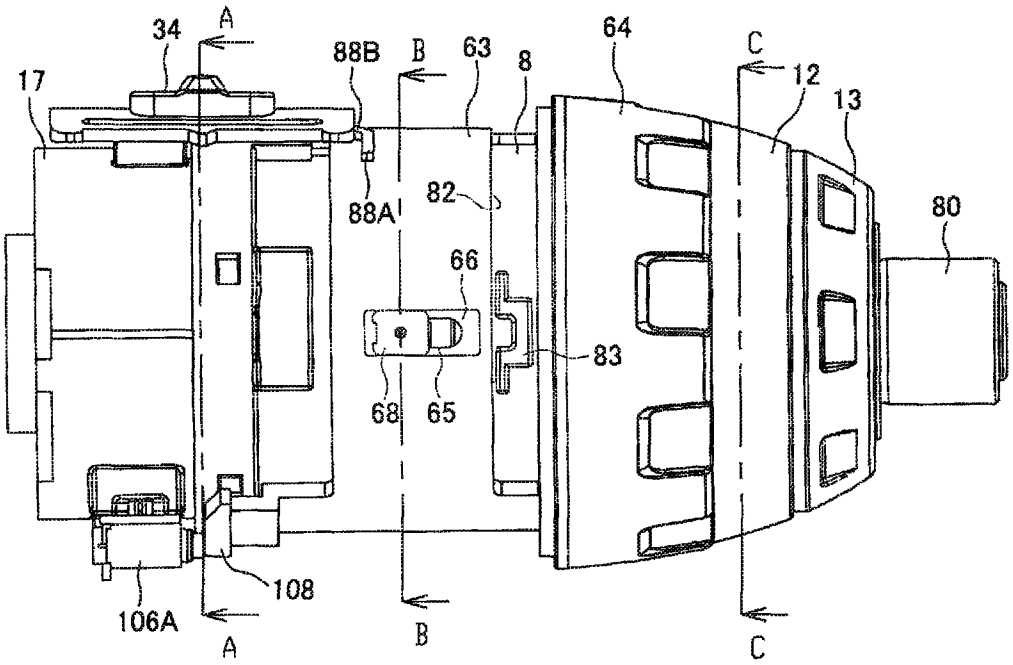
FIG. 5 is a left side view of a unit portion.
Figure 6A:
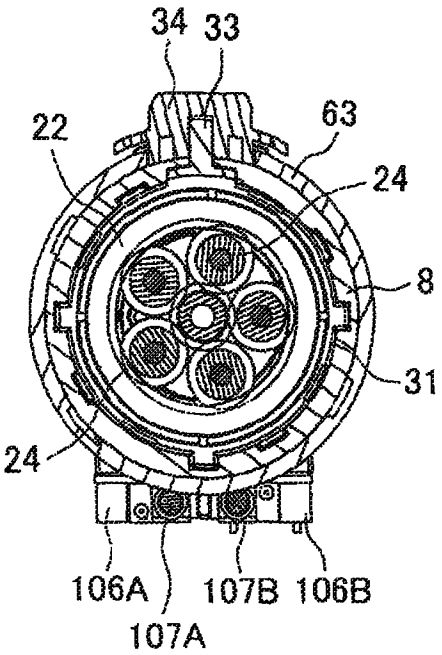
FIG. 6A is a sectional view along line A-A.

On the outside of the second internal gear 22, a slide ring 31 that is slidable forward or backward along the inner circumferential surface of the gear housing 17 and the inner housing 8 is provided, and an engagement pin 32 that penetrates the slide ring 31 in the radial direction from the outside is engaged with the engaging groove 27 of the second internal gear 22. On the outer circumference of the upper portion of the slide ring 31, a protrusion 33 that protrudes through the upper portion of the gear housing 17 is provided. As shown in FIGS. 5 and 6A, the protrusion 33 is held by a slide button 34 via coil springs 35 on the front and rear sides of the protrusion 33. The slide button 34 is provided to the body housing 2 so as to be slidable forward or backward.

As described above, a transmission mechanism is capable of switching the position of the second internal gear 22 forward or backward via the slide ring 31 by a slide operation of the slide button 34 to the front or the rear. That is, a high-speed mode (second speed) in which the second internal gear 22 rotates integrally with the spur gear 29 to cancel the planetary motion of the planet gear 24 is achieved in the forward position of the second internal gear 22 shown in FIGS. 1, 2, and 8. On the other hand, a low-speed mode (first speed) in which the second internal gear 22 is fixed to make the planetary motion of the planet gear 24 is achieved in the backward position of the second internal gear 22 shown in FIG. 12.

<Striking Mechanism>

The striking mechanism 9 has a structure by which a hammer is engaged with or disengaged from a pair of arms 11 provided at the rear end of the anvil 10. The hammer herein is divided into a cylinder-shaped main hammer 40 and a sub hammer 42 having a bottomed cylinder shape that opens to the front. The main hammer 40 is fitted to the exterior of the front end of the spindle 7 and provided with a pair of pawls 41 that protrude at the front surface to engage with the arms 11. The spindle 7 is loosely inserted to the sub hammer 42 so as to be coaxial therewith at the rear of the main hammer 40. A circumference wall 43 of the sub hammer 42 is fitted to the exterior of the main hammer 40 from the rear. The diameter formed of the diameter of the main hammer 40 and the thickness of the circumference wall 43 of the sub hammer 42 is equal to the outer diameter of a conventional hammer.

The main hammer 40 is connected to the spindle 7 via balls 46 that are fitted between reversed-shaped grooves 44 and V-shaped grooves 45. The reversed-shaped grooves 44 are provided to extend from the front end toward the rear on the inner circumferential surface of the main hammer 40 and are tapered at the rear end. The V-shaped grooves 45 are provided on the outer circumferential surface of the spindle 7 such that the front end thereof faces the front.

Between the main hammer 40 and the sub hammer 42, a coil spring 47 is fitted to the exterior of the spindle 7, so that the main hammer 40 is biased to the forward position in which the pawl 41 engages with the arm 11 and the sub hammer 42 is biased rearward. Between the sub hammer 42 and the second carrier 23, a washer 48 is fitted to the exterior of the spindle 7. At a ring groove 49 provided on the rear surface of the sub hammer 42, a plurality of balls 50 that protrude from the rear surface are accommodated to form a thrust bearing. The sub hammer 42 biased rearward by the coil spring 47 is pressed in a rotatable state to the rear position in which the ball 50 contacts the washer 48.

On the inner circumferential surface of the circumference wall 43 of the sub hammer 42, a plurality of guide grooves 51 extending from the front end in the axial direction to the rear are formed at equal intervals in the circumferential direction. On the outer circumference of the main hammer 40, a plurality of oval grooves 52 that are each shorter than the guide groove 51 are formed at the same intervals as the guide grooves 51 in the circumferential direction. Column-shaped connecting pins 53 are fitted between the guide groove 51 and the oval groove 52. The main hammer 40 and the sub hammer 42 are connected by the connecting pin 53 so as to move individually in the axial direction and integrally in the rotational direction.

Furthermore, on the outer circumferential surface of the main hammer 40 at the rear end, a ring-shaped fitting groove 54 is provided in the circumferential direction. On the circumference wall 43 of the sub hammer 42, a plurality of circular holes 55 that pass through the circumference wall 43 in the radial direction are formed between the guide grooves 51 in the rear end position of the guide groove 51. Each ball 56 is fitted with the circular hole 55.

A switching ring 57 is fitted to the exterior of the circumference wall 43 of the sub hammer 42. The switching ring 57 is stepped to have two diameters, that is, to have a small diameter portion 58 at the rear side and a large diameter portion 59 at the front side. The small diameter portion 58 slidingly contacts the outer circumferential surface of the circumference wall 43 and a large diameter portion 59 is apart from the outer circumferential surface of the circumference wall 43 in the radial direction. On the outer circumferential surface of the small diameter portion 58, a ring-shaped groove 60 is formed. The switching ring 57 is slidable forward or backward only between a front side step portion 61 provided on the inner circumference of the inner housing 8 and a rear side step portion 62 provided on the outer circumference at the rear end of the circumference wail 43.

As shown in FIGS. 4 and 5, a link sleeve 63 is fitted to the exterior of the inner housing 8. To the front end outer circumference of the link sleeve 63, a mode switching ring 64 serving as a switching operation member located at the front of the body housing 2 is fitted so as to be integrally rotatable. In point-symmetrical positions on the outer circumference of the link sleeve 63, a pair of through holes 65 that are oval and long in the front-rear direction are formed. On the outer circumferential surface along each through hole 65, a quadrangle-shaped guide recess portion 66 slightly larger than the through hole 65 is formed.

Figure 6B:
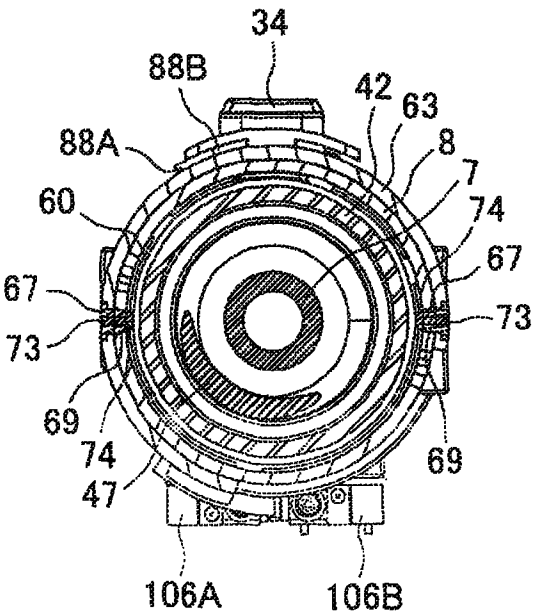
FIG. 6B is a sectional view along line B-B.

A cylinder-shaped guide holder 67 is formed at a square-shaped flange portion 68 of which an outer side end portion fits with the guide recess portion 66. The cylinder-shaped guide holder 67 penetrates the through hole 65 to protrude to the shaft center side of the link sleeve 63 in the radial direction and is made movable in the front-rear direction by the flange portion 68 being guided by the guide recess portion 66. In the inner housing 8, a guide groove 69 is provided. The guide groove 69 includes a front side groove 70, a rear side groove 71 and an inclined groove 72. The front side groove 70 is formed in the circumferential direction in a position corresponding to the front end of the through hole 65. The rear side groove 71 is formed in the circumferential direction in a position corresponding to the rear end of the through hole 65. The inclined groove 72 connects the front side groove 70 and the rear side groove 71, such that the guide holder 67 penetrates therethrough. As also shown in FIG. 6B, a guide pin 73 is inserted in the guide holder 67 from the shaft center side of the inner housing 8, and a head portion 74 of the guide pin 73 is fitted with the groove 60 of the switching ring 57.

In the anvil 10, a small-diameter tip end portion 76 provided to protrude at the front end of the spindle 7 is fitted in a bearing hole 75 formed on the rear surface at the shaft center, so that the anvil 10 coaxially supports the front end of the spindle 7 in a rotatable manner. The bearing hole 75 accommodates a ball 78 that is pressed by the end surface of the tip end portion 76 due to a coil spring 77 to receive load in the thrust direction.

Furthermore, at the front end of the anvil 10 protruding from the front housing 12, a mounting hole 79 for a bit is provided, and a chuck mechanism including a sleeve 80 or the like that presses a ball 81 (see FIG. 3) provided to the anvil 10 into the mounting hole in the backward position is provided in order to mount and retain the bit inserted in the mounting hole 79.

<Vibration Mechanism>

The vibration mechanism 90 is accommodated inside a front cylinder 37 joined coaxially with the front surface of the inner housing 8 and the front housing 12 fitted to the exterior of the front cylinder 37. In the front housing 12, as also shown in FIG. 4, a first cam 91 formed with a cam surface 91*a* at the rear surface is secured integrally to the anvil 10 and rotatably supported by a ball bearing 92 in the front housing 12. At the rear of the first cam 91, a second cam 93 formed with a cam surface 93*a* at the front surface is rotatably fitted to the exterior of the anvil 10. The rear surface of the second cam 93 is held by a plurality of balls 94 accommodated along a ring-shaped receiving metal 95 at the front surface of the inner housing 8, such that the can surface 93*a* is engaged with the cam surface 91*a* of the first cam 91 in a normal state. On the outer circumference of the second cam 93, a plurality of protrusions 96 that serve as a latched portion and protrude in the radial direction are formed at equal intervals in the circumferential direction.

Figure 6C:
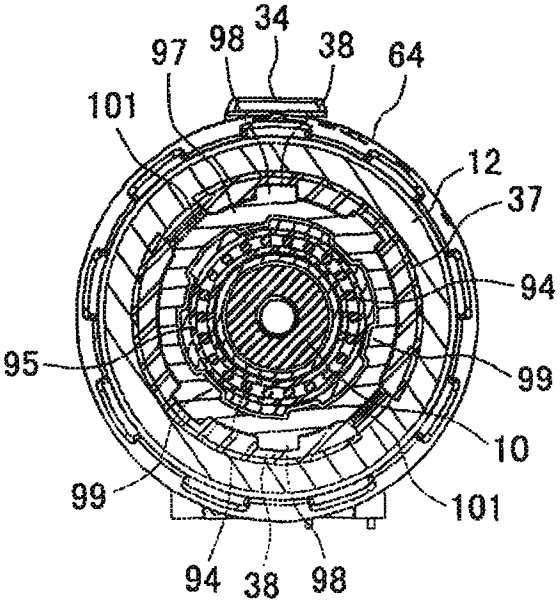
FIG. 6C is a sectional view along line C-C.

In the front cylinder 37, a vibration switching ring 97 is provided. The vibration switching ring 97 is a ring body having an inner diameter larger than the outer diameter of the second cam 93. As shown in FIG. 6C, a plurality of outer protrusions 98 provided on the outer circumference are fitted in restriction grooves 38 provided on the inner surface of the front cylinder 37 and extending in the axial direction, so that the vibration switching ring 97 is held to be movable forward or backward in a state where rotation is restricted in the front cylinder 37. On the inner circumference of the vibration switching ring 97, an inner protrusion 99 that serves as a latching portion and is provided to engage with the protrusion 96 of the second cam 93 in a state where the vibration switching ring 97 is fitted to the exterior of the second cam 93. In other words, the rotation of the second cam 93 is restricted in the forward position in which the vibration switching ring 97 is fitted to the exterior of the second cam 93, and the rotation of the second cam 93 is allowed in the backward position in which the vibration switching ring 97 is apart from the second cam 93. It should be noted that a coil spring 100 serving as a biasing unit is provided between the vibration switching ring 97 and the inner housing 8 in the front cylinder 37, so that the vibration switching ring 97 is biased to the forward position.

A pair of link plates 101 are latched to the vibration switching ring 97. The link plates 101 are band-shaped metal plates arranged point-symmetrically on the side surface at the front portion of the inner housing 8. Each of the link plates 101 has a rear plate portion 102, a middle plate portion 103 and a front plate portion 104. The rear plate portion 102 fits in the corresponding one of a pair of outer grooves 39 formed on the side surface of the inner housing 8 extending in the front-rear direction. The middle plate portion 103 goes a through hole 37*a* provided in the front cylinder 37 and bends inward from the rear plate portion 102. The front plate portion 104 protrudes forward along the inner surface of the front cylinder 37 from the middle plate portion 103 such that the front end bends inward. Thus, the link plate 101 is movable in the front-rear direction due to the rear plate portion 102 being guided by the outer groove 39. The rear plate portion 102 is fitted with the outer groove 39, and does not protrude from the outer circumferential surface of the inner housing 8. Reference numeral 105 denotes an engaging protrusion that is provided on the outer surface of the rear plate portion 102 to protrude outward. Each link plate 101 is biased together with the vibration switching ring 97 to the forward position due to the front end of the front plate portion 104 being latched onto the front surface of the vibration switching ring 97 from the outside.

The link sleeve 63 fitted to the exterior of the inner housing 8 is a cylinder-shaped body with a C-shaped cross section in which a part of the link sleeve 63 in the circumferential direction is cut out along the whole length in the axial direction. The link sleeve 63 has a cutout 82 extending along the circumferential direction at the middle portion. A guide protrusion 83 provided to the outer circumferential surface of the inner housing 8 is fitted with the cutout 82, so that the link sleeve 63 can rotate while a movement thereof in the front-rear direction is restricted. On the outer circumferential surface at the front side of the link sleeve 63, a connecting protrusion 84 that fits with a connecting groove 85 provided extending in the front-rear direction on the inner circumferential surface at the rear side of the mode switching ring 64 is provided. By the fitting of the connecting groove 85 and the connecting protrusion 84, the mode switching ring 64 and the link sleeve 63 are connected integrally in the rotational direction.

Figure 7A:
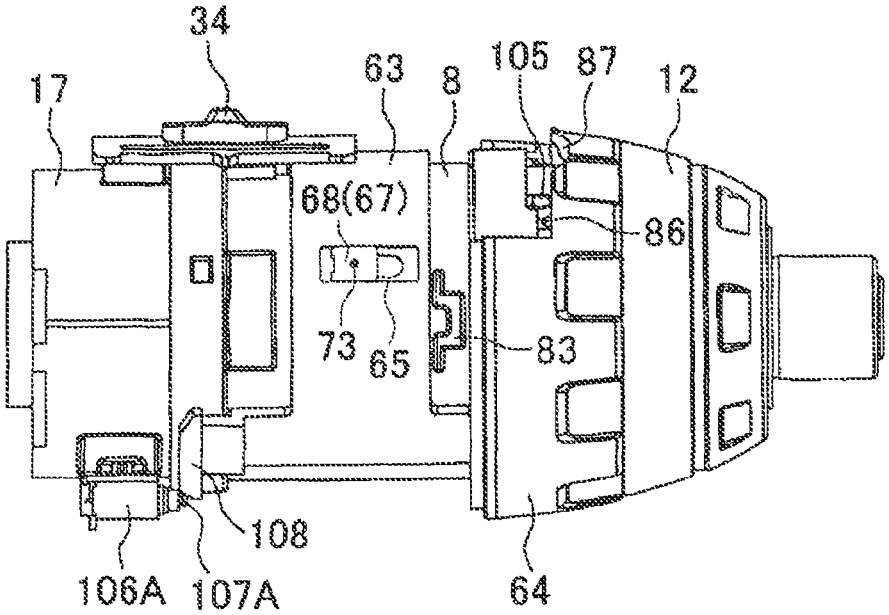
FIG. 7A is a left side view of the unit portion in an impact mode.

In the connected state, as shown in FIG. 7A, the engaging protrusion 105 of the link plate 101 is located between the front end of the link sleeve 63 and a step portion 86. The step portion 86 is provided along the circumferential direction on the inner circumferential surface of the mode switching ring 64. A part of the step portion 86 is a recess portion 87 provided to recess toward the front. The both sides in the circumferential direction are inclined in a tapered manner. When the engaging protrusion 105 is located in the recess portion 87, the link plate 101 is biased by the coil spring 100 to move forward to a first position in which the vibration switching ring 97 is allowed to move to the forward position. On the other hand, when the engaging protrusion 105 is located at the step portion 86 other than the recess portion 87, the link plate 101 moves backward to a second position in which the vibration switching ring 97 moves to the backward position against the bias of the coil spring 100.

On the outer circumferential surface at the rear side of the link sleeve 63, as shown in FIGS. 4 and 5, a first elongated protrusion 88A and a second elongated protrusion 88B are provided. The first elongated protrusion 88A extends along the circumferential direction. The second elongated protrusion 88B is inclined linearly from the end portion of the first elongated protrusion 88A toward the rear along the circumferential direction. In a corner portion at the front end and on the left side (left side being a direction when seen from the front; hereinafter, "left" and "right" represent directions seen from the front) on the lower surface of the slide button 34, a receiving protrusion 89 that engages with the tip end of the second elongated protrusion 88B when the link sleeve 63 rotates at the backward position for the first speed is provided. Thus, when the link sleeve 63 rotates, the receiving protrusion 89 is guided forward along the second elongated protrusion 88B, so that the slide button 34 moves forward. When the receiving protrusion 89 moves up to the front of the first elongated protrusion 88A, the slide button 34 reaches the forward position for the second speed.

On the lower surface of the gear housing 17 at the rear of the inner housing 8, a pair of microswitches 106A and 106B are arranged such that plungers 107A and 107B are directed forward. At the rear end of the link sleeve 63, a contact member 108 is provided. The contact member 108 performs pushing or release of the plungers 107A and 107B of the microswitches 106A and 106B in a predetermined switching position of the link sleeve 63 is provided. The microswitches 106A and 106B output an ON or OFF signal of a clutch mode to a controller (not shown) provided at the lower end of the handle 14 of the impact driver 1. The controller monitors a torque value obtained from a torque sensor (not shown) provided to the motor 4 when the ON signal is input upon pushing of the plunger 107B of the microswitch 106B and applies a brake to the motor 4 to block the torque transmitted to the anvil 10 when a set torque value is reached.

<Selection of Operation Mode>

The rotation position (switching position) of the mode switching ring 64 and the link sleeve 63 and each operation mode regarding the impact driver 1 configured as described above will be described.

Impact Mode

Figure 7B:
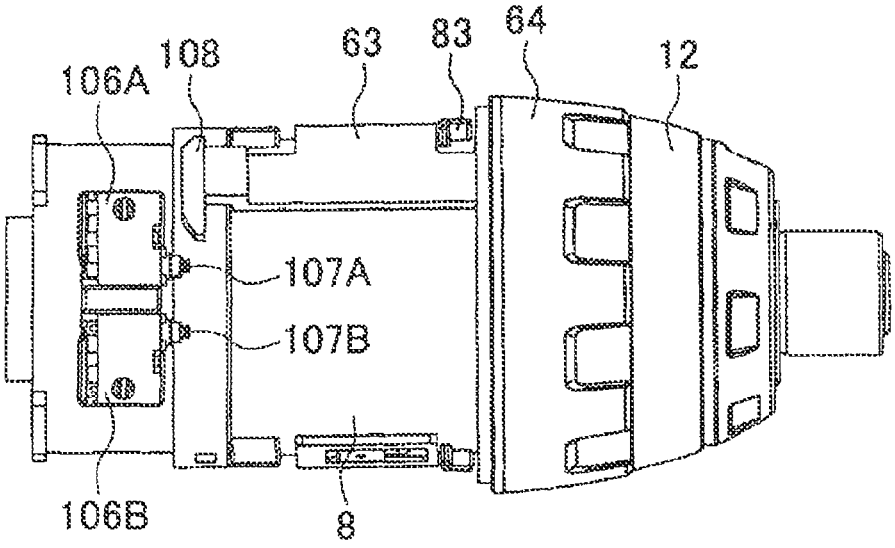
FIG. 7B is a bottom view thereof.
Figure 8:
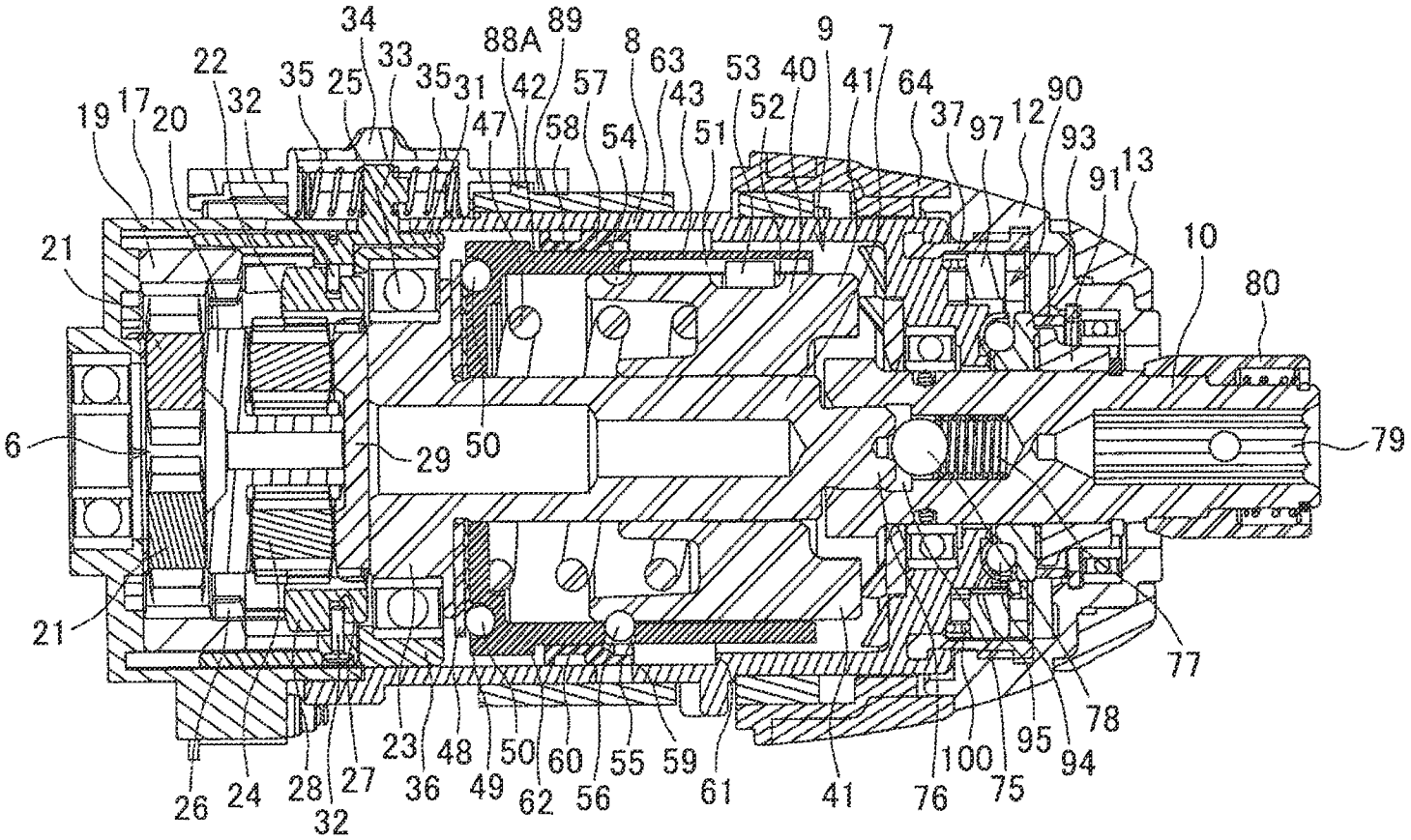
FIG. 8 is a vertical-sectional view of the unit portion in the impact mode.

First, in a first position in which the mode switching ring 64 is rotated to the rightmost position when seen from the front as shown in FIGS. 7A and 7B, the guide holder 67 also moves in the right rotation direction and moves in the guide groove 69 to reach the rear side groove 71. The guide holder 67 is located at the rear end of the through hole 65. Then, the switching ring 57 connected to the guide holder 67 via the guide pin 73 is in the backward position in which the large diameter portion 59 is located outside the ball 56, as shown in FIG. 8. In the backward position, the ball 56 can move to a release position to sink in the inner circumferential surface of the circumference wall 43 and be apart from the fitting groove 54 of the main hammer 40, thus achieving an impact mode that allows a backward movement of the main hammer 40.

At this time, the first elongated protrusion 88A is located in the rear of the receiving protrusion 89 of the slide button 34 to move the slide button 34 to the forward position. Therefore, a backward movement of the slide button 34 is restricted, and the high-speed mode is achieved constantly. The engaging protrusion 105 of the link plate 101 is displaced to the left side from the recess portion 87 and latched the step portion 86. Therefore, the link plate 101 is in the backward position, causing the vibration switching ring 97 to move backward and allowing the second cam 93 to rotate. (It should be noted that in FIG. 7A and the subsequent side views of a unit portion, the mode switching ring 64 is shown with a partial cutout for the sake of illustrating the position of the engaging protrusion 105.) The contact member 108 is not in contact with either of the plungers 107A and 107B of the microswitches 106A and 106B.

Therefore, when the trigger 16 provided to the handle 14 is manipulated to drive the motor 4, the rotation of the output shaft 5 is transmitted to the spindle 7 via the planetary gear reduction mechanism 6, rotating the spindle 7. The spindle 7 causes the main hammer 40 to rotate via the ball 46, and the anvil 10 is engaged with the main hammer 40 to rotate. Therefore, thread fastening or the like is possible with a bit fitted to the tip end of the anvil 10. At this time, the sub hammer 42 connected to the main hammer 40 in the rotational direction via the connecting pin 53 also rotates integrally with the main hammer 40. It should be noted that even if the first cam 91 is rotated along with the rotation of the anvil 10, the second cam 93 engaged with the first cam 91 is allowed to rotate. Therefore, the second cam 93 also rotates integrally, and vibration does not occur in the anvil 10.

When the torque of the anvil 10 is increased by further thread fastening, a difference occurs between the rotation of the main hammer 40 and the rotation of the spindle 7. Therefore, the ball 46 rolls along the V-shaped groove 45, causing the main hammer 40 to move backward against the bias of the coil spring 47 while rotating relatively with respect to the spindle 7. The sub hammer 42 at this time rotates integrally with the main hammer 40 with the connecting pin 53 therebetween while allowing a backward movement of the main hammer 40.

Then, when the pawl 41 of the main hammer 40 is disengaged from the arm 11, the coil spring 47 is biased and the ball 46 is rolled toward the tip end of the V-shaped groove 45, and then the main hammer 40 is moved forward while rotating. Thus, the pawl 41 of the main hammer 40 engages with the arm 11 again to generate a rotational striking force (impact). By repeating the engagement with and disengagement from the anvil 10, the tightness is increased.

In the above state, the sub hammer 42 also rotates together with the main hammer 40, and the engagement with and disengagement from the anvil 10 involves a sum of the mass of the hammers 40 and 42. Due to the rotational resistance being reduced by the ball 50 on the rear surface rolling on the front surface of the washer 48 at the time of rotation, the sub hammer 42 can rotate smoothly even if the coil spring 47 is extended or compressed along with the front or back movement of the main hammer 40. Furthermore, even if the main hammer 40 repeats the front or back movement at the time of impact occurrence, the sub hammer 42 maintains the backward position and does not move forward or backward, thus preventing vibration at the time of impact occurrence.

Vibration Drill Mode

Figure 9A:
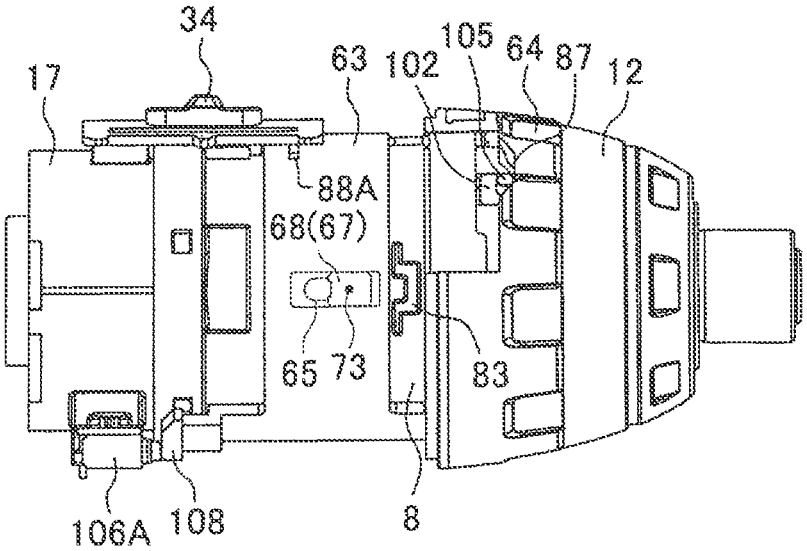
FIG. 9A is a left side view of the unit portion in a vibration drill mode.
Figure 9B:
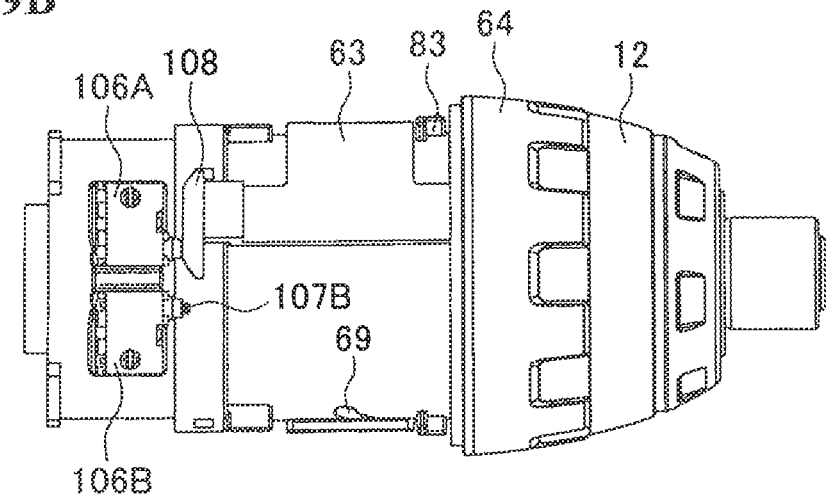
FIG. 9B is a bottom view thereof.
Figure 10:
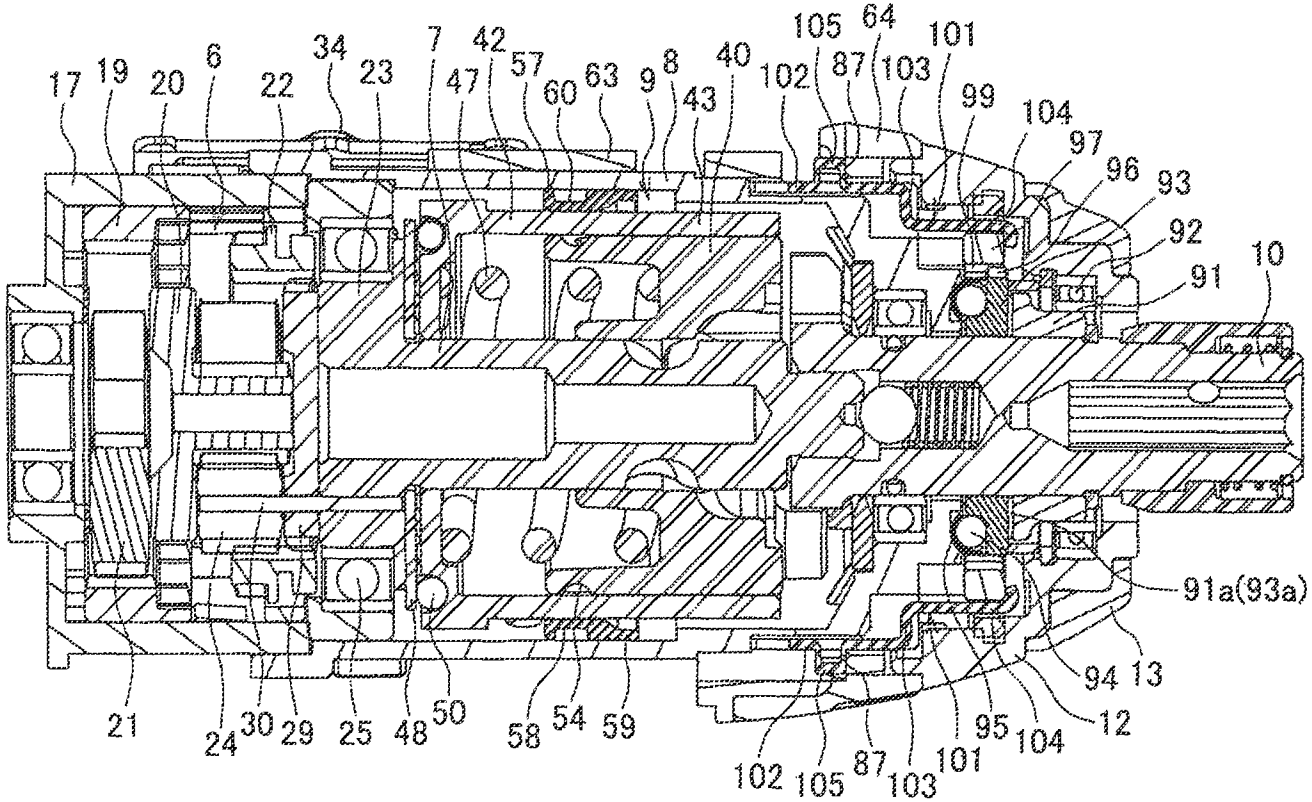
FIG. 10 is a vertical-sectional view of the unit portion in the vibration drill mode.
Figure 12:
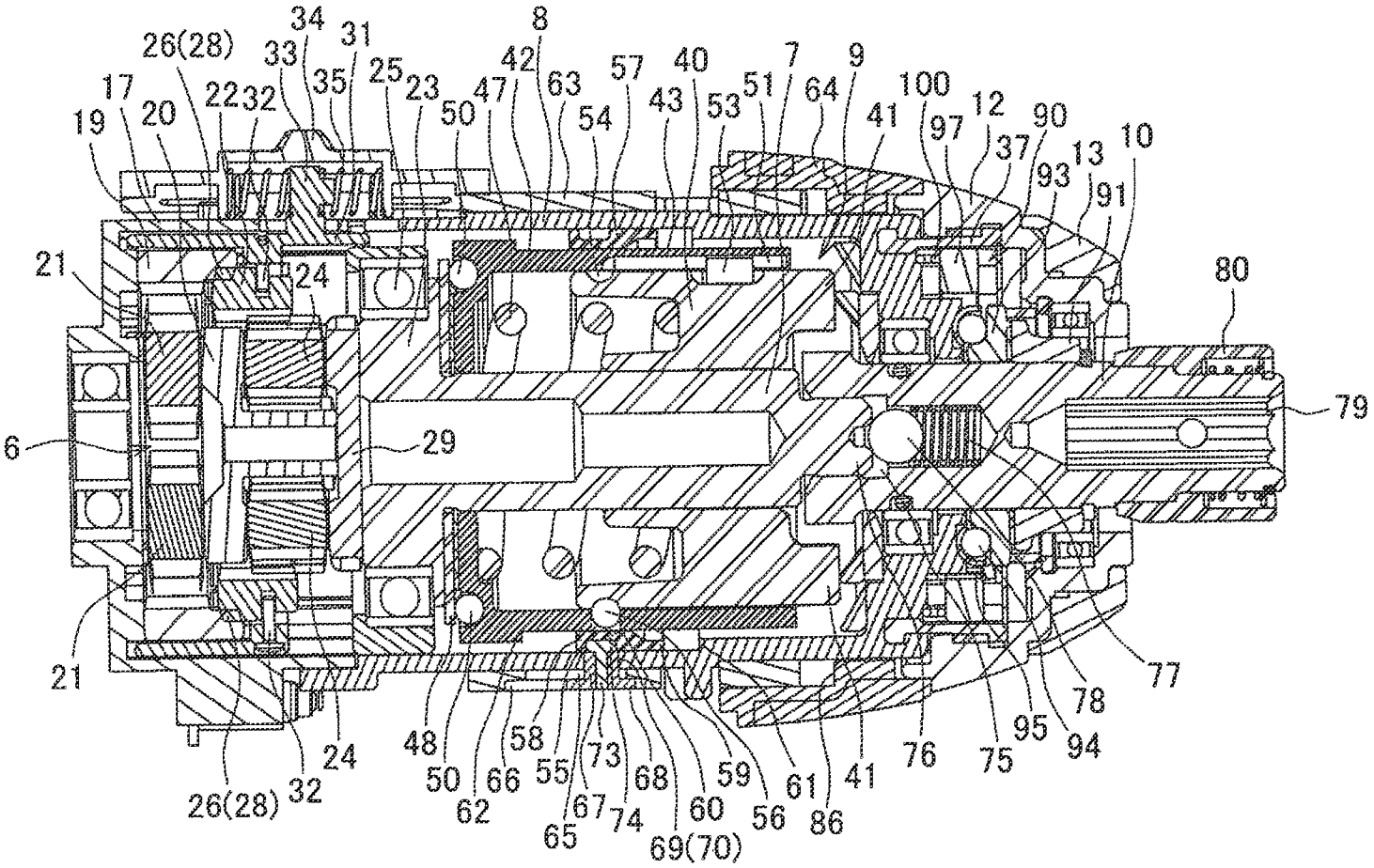
FIG. 12 is a vertical-sectional view of the unit portion in the drill mode.

Next, in a second position in which the mode switching ring 64 is rotated to the left to a predetermined angle from the first position as shown in FIGS. 9A and 9B, the guide holder 67 also moves in the left rotation direction in the circumferential direction and moves in the guide groove 69 to reach the front side groove 70. The guide holder 67 is located at the front end of the through hole 65. The switching ring 57 is in the forward position in which the small diameter portion 58 is located outside the ball 56, as shown in FIG. 10. In the forward position, the ball 56 is pushed by the small diameter portion 58 as shown in FIG. 12 and fixed to a connecting position to fit with the fitting groove 54 of the main hammer 40. Therefore, the main hammer 40 and the sub hammer 42 are connected in the front-rear direction such that a backward movement of the main hammer 40 is restricted.

At this time, the engaging protrusion 105 of the link plate 101 moves forward and fits with the recess portion 87, because the recess portion 87 is in the same phase. Thus, the vibration switching ring 97 moves to the forward position, and a vibration drill mode that restricts the rotation of the second cam 93 is achieved.

It should be noted that when the link plate 101 moves forward, the vibration switching ring 97 may not be able to move to the forward position due to a match in phase between the inner protrusion 99 of the vibration switching ring 97 and the protrusion 96 of the second cam 93. However, when the first cam 91 rotates together with the anvil 10 to rotate the second cam 93 that engages with the first cam 91, a difference occurs in phase between the protrusion 96 and the inner protrusion 99 because the vibration switching ring 97 is biased by the coil spring 100. Therefore, the vibration switching ring 97 is able to move forward and restrict the rotation of the second cam 93.

The first elongated protrusion 88A is still located in the rear of the receiving protrusion 89 in the same manner as in the impact mode. Therefore, a backward movement of the slide button 34 is restricted, and the high-speed mode is achieved constantly. The contact member 108 presses only the plunger 107A of the microswitch 106A, and therefore a clutch is not activated.

When the trigger 16 is manipulated to rotate the spindle 7, the spindle 7 causes the main hammer 40 to rotate via the hall 46, thereby engaging the anvil 10 with the main hammer 40 to rotate. When the first cam 91 rotates along with the rotation of the anvil, the cam surface 91*a* and the cam surface 93*a* of the second cam 93 of which the rotation is restricted interfere with each other. The anvil 10 is rotatably supported in a state where there is a play in the front and the rear of the arm 11. Therefore, due to the interference between the cam surfaces 91*a* and 93*a*, vibration of the anvil 10 occurs in the axial direction. The sub hammer 42 connected to the main hammer 40 in the rotational direction via the connecting pin 53 also rotates integrally with the main hammer 40.

An engagement or disengagement operation of the main hammer 40 with respect to the anvil 10 is not performed even if the torque of the anvil 10 increases, because a backward movement of the main hammer 40 is restricted by the ball 56. Thus, impact does not occur, and the anvil 10 rotates integrally with the spindle 7.

Drill Mode

Figure 11A:
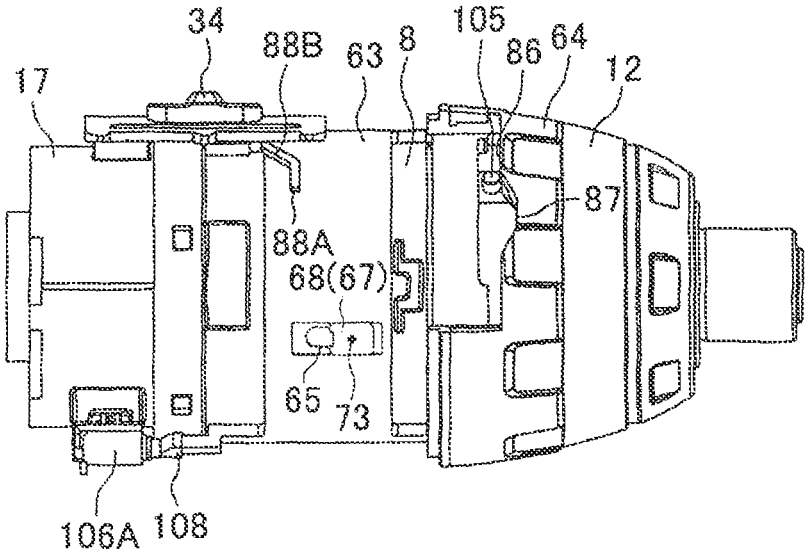
FIG. 11A is a left side view of the unit portion in a drill mode.
Figure 11B:
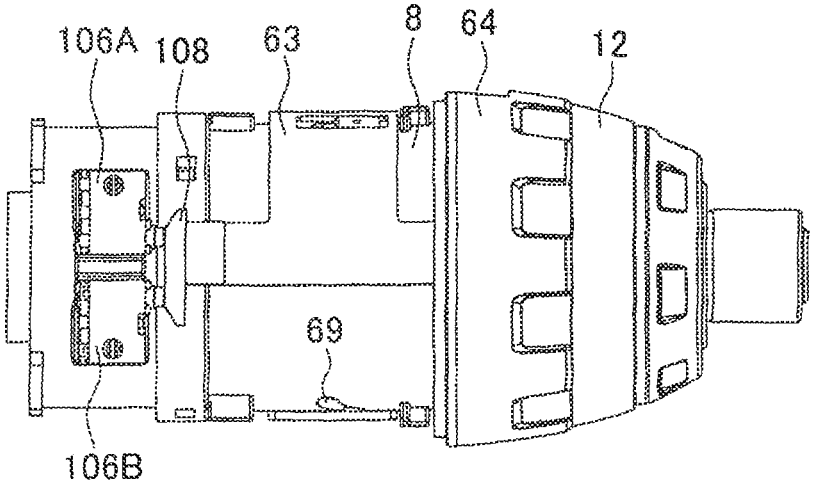
FIG. 11B is a bottom view thereof.

Next, in a third position in which the mode switching ring 64 is rotated to the left to a predetermined angle from the second position as shown in FIGS. 11A and 11B, the guide holder 67 also moves in the left rotation direction in the circumferential direction but stays located in the front side groove 70. Therefore, the state in which the guide holder 67 is located at the front end of the through hole 65 does not change. Accordingly, as also shown in FIG. 12, the switching ring 57 is in the forward position, and the ball 56 is pushed by the small diameter portion 58 and fixed in the connecting position to fit with the fitting groove 54 of the main hammer 40. Thus, the main hammer 40 and the sub hammer 42 are connected in the front-rear direction, a drill mode in which a backward movement of the main hammer 40 is restricted is achieved.

In the above state, the engaging protrusion 105 of the link plate 101 is latched the step portion 86 again due to the recess portion 87 moving to the left side. Therefore, the link plate 101 is in the backward position, causing the vibration switching ring 97 to move backward and allowing the second cam 93 to rotate freely. The contact member 108 simultaneously presses the plungers 107A and 107B of both of the microswitches 106A and 106B, and therefore the clutch is not activated.

The first elongated protrusion 88A moves away from the slide button 34 to the left side and the end portion of the second elongated protrusion 88B is located in the rear of the receiving protrusion 89. Therefore, a backward movement of the slide button 34 becomes possible, as shown in FIG. 12. Thus, either mode of high or low speed can be selected.

When the trigger 16 is manipulated to rotate the spindle 7, the spindle 7 causes the main hammer 40 to rotate via the ball 46, thereby causing the anvil 10 engaged with the main hammer 40 to rotate. At this time, the sub hammer 42 connected to the main hammer 40 in the rotational direction via the connecting pin 53 also rotates integrally with the main hammer 40. It should be noted that even if the first cam 91 rotates along with the rotation of the anvil 10, vibration does not occur in the anvil 10 because the second cam 93 opposing the first cam 91 is rotatable.

An engagement or disengagement operation of the main hammer 40 with respect to the anvil 10 is not performed even if the torque of the anvil 10 increases, because a backward movement of the main hammer 40 is restricted by the ball 56. Thus, impact does not occur, and the anvil 10 rotates integrally with the spindle 7.

Clutch Mode

Figure 13A:
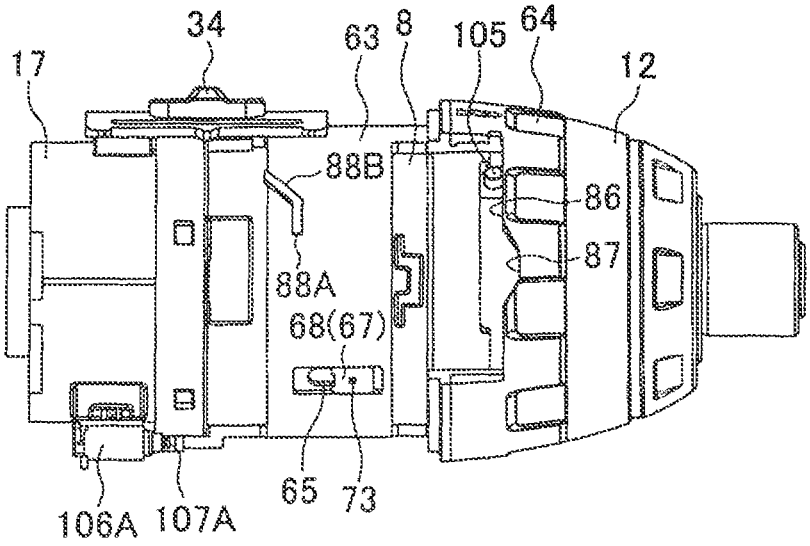
FIG. 13A is a left side view of the unit portion in a clutch mode.
Figure 13B:
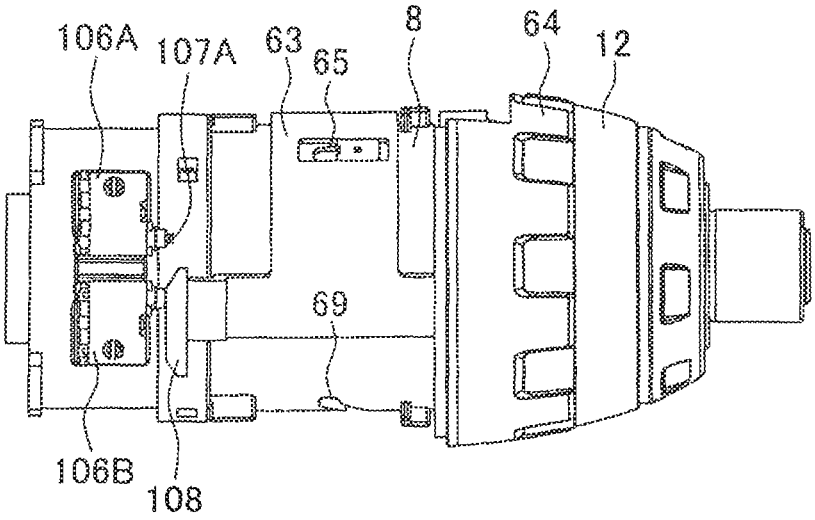
FIG. 13B is a bottom view thereof.
Figure 14:
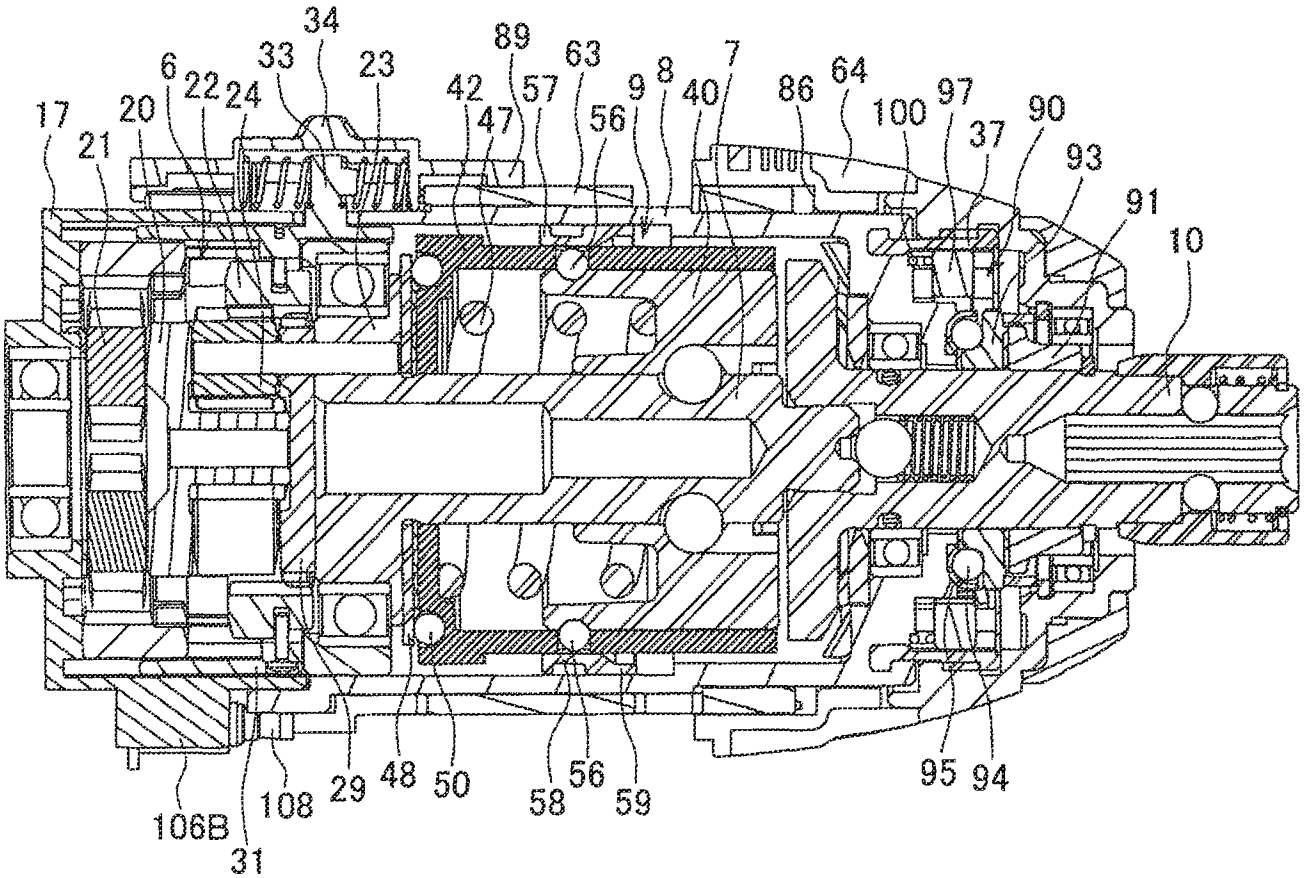
FIG. 14 is a vertical-sectional view of the unit portion in the clutch mode.

Next, in a fourth position in which the mode switching ring 64 is rotated to the left to a predetermined angle from the third position as shown in FIGS. 13A and 13B, the guide holder 67 also moves in the left rotation direction in the circumferential direction but stays located in the front side groove 70. Therefore, the state in which the guide holder 67 is located at the front end of the through hole 65 does not change, as shown in FIG. 14. Thus, the switching ring 57 is in the forward position, such that the ball 56 is pushed by the small diameter portion 58 and fixed in the connecting position to fit with the fitting groove 54 of the main hammer 40. The main hammer 40 and the sub hammer 42 are connected in the front-rear direction to restrict a backward movement of the main hammer 40.

At this time, the engaging protrusion 105 of the link plate 101 is latched to the step portion 86 in the same manner as in the third position. Therefore, the link plate 101 is in the backward position and the vibration switching ring 97 is moved backward to make the second cam 93 rotatable. It should be noted that the contact member 108 presses only the plunger 107B of the microswitch 106B, and therefore the clutch mode is achieved.

The first and second elongated protrusions 88A and 88B are apart to the left side from the slide button 34. Therefore, a slide operation of the slide button 34 to either the front or the rear is possible.

Therefore, when the trigger 16 is manipulated to rotate the spindle 7, the spindle 7 causes the main hammer 40 to rotate via the hall 46, thereby causing the anvil 10 engaged with the main hammer 40 to rotate. At this time, the sub hammer 42 connected to the main hammer 40 in the rotational direction via the connecting pin 53 also rotates integrally with the main hammer 40. It should be noted that even if the first cam 91 rotates along with the rotation of the anvil 10, vibration does not occur in the anvil 10 because the second cam 93 opposing the first cam 91 is rotatable.

Then, when the torque of the anvil 10 increases and the torque value detected by the torque sensor reaches the set torque value, brake is applied to the motor 4 such that the torque transmission from the spindle 7 to the anvil 10 is blocked.

It should be noted that, as shown in FIG. 2, indications M1 (impact mode), M2 (vibration drill mode), M3 (drill mode), and M4 (clutch mode) corresponding to respective operation modes are indicated on the outer circumferential surface of the mode switching ring 64. Each operation mode is selected by aligning each indication to an arrow 109 indicated at the front end on the upper surface of the body housing 2.

In the case of switching from the drill mode or the clutch mode used at low speed to the vibration drill mode or the impact mode, the operation is performed in reverse. More specifically, the second elongated protrusion 88B apart from the slide button 34 engages with the receiving protrusion 89 of the slide button 34 in the backward position due to the rightward rotation of the link sleeve 63. The receiving protrusion 89 is caused to slide relatively along the second elongated protrusion 88B along with the rotation of the link sleeve 63 and the slide button 34 is caused to move to the forward position. Thus, the high-speed mode is achieved constantly in the vibration drill mode and the impact mode.

In this manner, in the impact driver 1 in the embodiment described above, a vibration switching member is the vibration switching ring 97 fitted to the exterior of the second cam 93 in the forward position. The inner protrusion 99 provided on the inner circumference is latched the protrusion 96 provided on the outer circumference of the second cam 93 so that the rotation of the second cam 93 is restricted. Further, the coil spring 100 is provided for biasing the vibration switching ring 97 to the forward position. The impact driver 1 also includes the link plate 101 between the mode switching ring 64 and the vibration switching ring 97. The link plate 101 latches onto the front surface of the vibration switching ring 97 from the outer circumference side to cause the engaging protrusion 105 at the rear end to engage with the mode switching ring 64. Through manipulation of the mode switching ring 64, the link plate 101 moves forward or backward to the first position in which the vibration switching ring 97 moves to the forward position or the second position in which the vibration switching ring 97 moves to the backward position. This enables a space-saving configuration of the entire vibration mechanism 90 including the vibration switching ring 97. Thus, downsizing of the entire tool can be realized.

Particularly herein, the inner housing 8 that rotatably supports the anvil 10 and holds the vibration mechanism 90 is provided in the body housing 2, and the link plate 101 is held to be movable forward or backward in the outer groove 39 provided on the outer circumference of the inner housing 8. Therefore, the link plate 101 can be arranged without being protruded from the outer circumference of the inner housing 8. Thus, downsizing in the radial direction can be also realized.

Although in the embodiment described above, when the vibration switching ring is fitted to the exterior of the second cam, the restriction of rotation is performed by the latching between the inner protrusion provided on the inner circumference of the vibration switching ring and the protrusion provided on the second cam. However, modifications may appropriately be made obviously to the number of the inner protrusions or the protrusions and also to the shape thereof such that, for example, protrusions of which the cross section is reversed V-shaped are formed continuously to mesh with each other, or the like.

The link plate may also be modified in number as well as in design to a linear plate shape or the like as a whole in which the middle plate portion is omitted, depending on the positional relationship with the second cam.

Furthermore, the planetary gear reduction mechanism, the striking mechanism, or the like is not limited to the configuration described above. For example, the present invention can be applied to a tool where a speed change mechanism is not provided, or switching between the impact mode and the drill mode cannot be performed, or the like. Further, the switching operation member is also not limited to the mode switching ring in the form described above with which a rotating operation is performed, and a configuration in which the link plate moves forward or backward by a slide operation in the front-rear direction may be adopted, depending on the configuration of the electric power tool with a vibration mechanism.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. An electric power tool with a vibration mechanism, comprising:

a motor;

a final output shaft configured to rotate about a longitudinal axis and to which rotation is transmitted from the motor;

a vibration mechanism including a first cam secured integrally to the final output shaft such that the first cam and final output shaft move together, a second cam that interlocks with a rear of the first cam and is provided to an exterior of the final output shaft so as to be rotatable relative to the final output shaft, and a vibration switching member configured to move between a first position in which the vibration switching member is latched to the second cam so as to restrict relative rotation between the second cam and the final output shaft and a second position in which the vibration switching member is positioned apart from the second cam, such that the second cam rotates relative to the final output shaft, thus causing vibration in an axial direction provided to the final output shaft; and a switching operation member that is provided to the housing and causes the vibration switching member to move between the first position and the second position; wherein the vibration switching member is a ring body and a first protrusion provided on an outer circumference of the second cam is configured to latch a second protrusion provided on an inner circumference of the vibration switching member, the first protrusion protruding radially outwardly and the second protrusion protruding radially inwardly.

2. The electric power tool with a vibration mechanism according to claim 1, further comprising a link plate latching onto an outer circumferential surface of the vibration switching member so as to engage a rear end of the link plate with the switching operation member, and further configured to move between a vibration position and non-vibration position, through manipulation of the switching operation member, such that in the non-vibration position the vibration switching member is in the first position and, and in the vibration position the vibration switching member is in the second position.

3. The electric power tool with a vibration mechanism according to claim 2, wherein an inner housing that rotatably supports the final output shaft and holds the vibration mechanism is provided in the housing, and the link plate is held to be movable forward or backward in an outer groove provided on an outer circumference of the inner housing.

4. The electric power tool with a vibration mechanism according to claim 3, wherein a front cylinder that accommodates the vibration mechanism is formed to protrude at a front end of the inner housing.

5. The electric power tool with a vibration mechanism according to claim 4, wherein the link plate includes a rear plate portion that fits with the outer groove, a middle plate portion that passes through a through hole provided to the front cylinder of the inner housing and bends inward from the rear plate portion, and a front plate portion that protrudes forward along an inner surface of the front cylinder from the middle plate portion such that a front end bends inward to latch the vibration switching member.

6. The electric power tool with a vibration mechanism according to claim 3, wherein a pair of the outer grooves and a pair of the link plates are provided.

7. The electric power tool with a vibration mechanism according to claim 3, wherein the switching operation member is a mode switching ring provided so as to be rotatable on an outside of the inner housing.

8. The electric power tool with a vibration mechanism according to claim 7, wherein an engaging protrusion formed on an outer surface of the rear plate portion contacts a step portion formed in a circumferential direction on an inner circumferential surface of the mode switching ring, partially including a recess portion, and, through a rotating operation of the mode switching ring, the link plate moves forward to the non-vibration position when the recess portion is located in front of the engaging protrusion and the link plate moves backward to the vibration position by causing the step portion other than the recess portion is located in front of the engaging protrusion.

9. The electric power tool with a vibration mechanism according to claim 7, wherein the vibration switching member is a vibration switching ring that is held to be movable forward or backward in a state where rotation is restricted in the front cylinder in such a manner that a plurality of outer protrusions provided to an outer circumference are fitted with a restriction groove provided on an inner surface of the front cylinder in the axial direction.

10. The electric power tool with a vibration mechanism according to claim 9, wherein the latching portion is a plurality of inner protrusions formed to protrude on an inner circumference of the vibration switching ring, and the latched portion is a plurality of protrusions formed to protrude in a radial direction from the outer circumference of the second cam.

11. The electric power tool with a vibration mechanism according to claim 3, wherein a rear surface of the second cam is held by a plurality of balls accommodated along a ring-shaped receiving metal at a front surface of the inner housing.

12. A vibrating electric power tool comprising:

an electric motor;

a microswitch;

a final output shaft extending along a longitudinal axis and configured to rotate about the axis in response to activation of the motor;

a vibration mechanism configured to cause the final output shaft to vibrate in the longitudinal direction in response to rotation of the final output shaft;

a mode switching member capable of operating the microswitch and switching modes between a clutch mode in which the vibration mechanism is not used and a vibration mode in which the vibration mechanism is used; and a controller configured to receive signal from the mode switching member, the vibration mechanism further comprising:

a first cam secured to the final output shaft such that the first cam and final output shaft integrally move together, the first cam having first cam surfaces extending in the longitudinal direction;

a second cam configured to rotate around, and with respect to, the final output shaft, the second cam having second cam surfaces extending in the longitudinal direction and configured to cooperate with the first cam surfaces such that relative rotation between the first and second cams causes the first and second cams to move in the longitudinal direction with respect to each other, thus causing the final output shaft to vibrate along the longitudinal axis, an electric clutch configured to stop rotation of the electric motor upon receipt of an electric signal indicating that an external torque applied to the final output shaft exceeds a user configurable predetermined amount.

13. The vibrating electric power tool according to claim 12, wherein the final output shaft includes an arm with which a hammer is engaged so as to cause rotary impact force.

14. A vibrating electric power tool comprising:

an electric motor;

a final output shaft extending along a longitudinal axis and configured to rotate about the axis in response to activation of the motor;

a vibration mechanism configured to cause the final output shaft to vibrate in the longitudinal direction in response to rotation of the final output shaft, wherein the vibration mechanism further comprises:

a first cam secured to the final output shaft such that the first cam and final output shaft integrally move together, the first cam having first cam surfaces extending in the longitudinal direction;

a second cam configured to rotate around and with respect to the final output shaft, the second cam having second cam surfaces extending in the longitudinal direction and configured to cooperate with the first cam surfaces such that relative rotation between the first and second cams causes the first and second cams to move in the longitudinal direction with respect to each other, thus causing the final output shaft to vibrate along the longitudinal axis, a bearing is provided radially outside of and axially overlapping the first cam.

15. An electric power tool comprising:

a micro switch;

a mode switching member capable of operating the microswitch;

a controller configured to receive signal from the microswitch;

a motor;

a spindle rotated by the motor;

a hammer rotatable by the spindle;

a torque sensor that senses a torque transmission;

an anvil that provides, by virtue of the motor, a striking force in a rotational direction; and a mode switching member capable of switching modes among a first mode, a second mode, and a third mode, wherein:

the first mode is configured to provide a striking force to the anvil by the hammer, the second mode is configured to enable the anvil to constantly rotate integrally with the spindle, the third mode is configured to rotate the anvil integrally with the spindle and to block torque transmission from the motor to the anvil when a value of the torque transmission sensed by the torque sensor reaches a set torque value and the controller is configured to monitor the value.

* * * * *